US011420309B2

(12) United States Patent
Chen et al.

(10) Patent No.: US 11,420,309 B2
(45) Date of Patent: Aug. 23, 2022

(54) MULTI-SECTION UNIVERSAL TOOL

(71) Applicant: YUAN LI HSING INDUSTRIAL CO., LTD., Taichung (TW)

(72) Inventors: Hui-Chien Chen, Taichung (TW); Chia-Yi Chen, Taichung (TW)

(73) Assignee: YUAN LI HSING INDUSTRIAL CO., LTD., Taichung (TW)

( * ) Notice: Subject to any disclaimer, the term of this patent is extended or adjusted under 35 U.S.C. 154(b) by 227 days.

(21) Appl. No.: 16/927,409

(22) Filed: Jul. 13, 2020

(65) Prior Publication Data

US 2020/0338700 A1 Oct. 29, 2020

Related U.S. Application Data

(63) Continuation-in-part of application No. 16/107,038, filed on Aug. 21, 2018, now abandoned.

(51) Int. Cl.
*B25B 23/00* (2006.01)
*B25B 13/48* (2006.01)

(52) U.S. Cl.
CPC ..... *B25B 23/0014* (2013.01); *B25B 13/481* (2013.01); *B25B 23/0021* (2013.01); *B25B 23/0035* (2013.01)

(58) Field of Classification Search
CPC ..... B25B 23/0014; B25B 23/0021; B25B 23/0035; B25B 13/481
USPC ..... 81/177.85
See application file for complete search history.

(56) References Cited

U.S. PATENT DOCUMENTS

| | | | | |
|---|---|---|---|---|
| 827,250 | A | 7/1906 | Measer | |
| 3,897,703 | A | 8/1975 | Phipps | |
| 8,096,212 | B2 * | 1/2012 | Su | B25G 3/38 81/177.85 |
| 8,176,817 | B2 | 5/2012 | Liu | |
| 8,366,339 | B2 * | 2/2013 | Lin | F16D 1/108 403/57 |
| 2010/0294089 | A1 | 11/2010 | Lai | |
| 2014/0187338 | A1 | 7/2014 | Chen | |

* cited by examiner

*Primary Examiner* — Hadi Shakeri
(74) *Attorney, Agent, or Firm* — Muncy, Geissler, Olds & Lowe, P.C.

(57) ABSTRACT

A multi-section universal tool includes an assembling member, a connecting member, a working member and two elastic members. The assembling member has an assembling portion and a first receiving room. The connecting member includes a connecting ball joint and a second receiving room. The connecting ball joint includes a connecting elastic abutting member which has a tendency to radially move outwardly. The connecting ball joint is inserted into the first receiving room and movable relative to the first receiving room to be in a first connecting position or a second connecting position. The working member includes a working ball joint including a working elastic abutting member which has a tendency to radially move outwardly. The working ball joint is inserted into the second receiving room and movable relative to the second receiving room to be in a first working position or a second working position.

10 Claims, 8 Drawing Sheets

MULTI-SECTION UNIVERSAL TOOL

The present invention is a CIP of application Ser. No. 16/107,038, filed Aug. 21, 2018, the entire contents of which are hereby incorporated by reference.

BACKGROUND OF THE INVENTION

Field of the Invention

Description of the Prior Art

A universal joint is a kind of hand tool which is rotatable at various angles. The universal joint is usually used to connect a driving tool (such as a wrench, pneumatic or power tool) with a fastener (such as a socket or screw). A conventional universal joint includes a ball head seat and a driving lever. One end of the driving lever has a ball head which is nonrotatably and slidably disposed within the ball head seat. The driving lever is slidable to be in a fixed position or a swing position relative to the ball head seat. A radial projection of the driving lever is abutted against the ball head seat and is nonswingable relative to the ball head seat when the driving lever is in the fixed position. The radial projection of the driving lever is unabutted against the ball head seat and is swingable relative to the ball head seat when the driving lever is pulled toward the swing position. As a result, the universal joint is rotatable at various angles for easy operation in a narrow space. However, the universal joint is unreachable to the screwing member by assembly of the universal joint and the driving tool when the space is too long and narrow, which needs to be improved.

The present invention is, therefore, arisen to obviate or at least mitigate the above-mentioned disadvantages.

SUMMARY OF THE INVENTION

The main object of the present invention is to provide a multi-section universal tool, which is flexible to operate within a long and narrow space.

To achieve the above and other objects, the present invention provides a multi-section universal tool, including an assembling member, a connecting member, a working member and two elastic members. The assembling member has an assembling portion and a first receiving room which has a polygonal cross section. An inner wall of the first receiving room has a first recessed portion. The connecting member includes a connecting ball joint which is polygonal and a second receiving room. The connecting ball joint includes a connecting elastic abutting member which has a tendency to move radially outward, and an inner wall of the second receiving room has a second recessed portion. The connecting ball joint is inserted into the first receiving room and movable relative to the first receiving room to be in a first connecting position and a second connecting position farther than the first connecting position from the assembling portion. The working member includes a working ball joint which is polygonal and a working portion. The working ball joint includes a working elastic abutting member which has a tendency to radially move outwardly, the working ball joint is inserted into the second receiving room and movable relative to the second receiving room to be in a first working position or a second working position farther than the first working position from the connecting ball-joint. One of the two elastic members is disposed between the first receiving room and the connecting ball joint so that the connecting ball joint has a tendency to move normally toward the second connecting position, and the other of the two elastic members is disposed between the second receiving room and the working ball joint so that the working ball joint has a tendency to move normally toward the second working position. Wherein the connecting elastic abutting member is elastically engaged within the first recessed portion and the connecting member is nonswingable relative to the assembling member when the connecting ball joint is in the first connecting position; when the connecting ball joint is moved toward the second connecting position, the connecting elastic abutting member is disengaged from the first recessed portion, the connecting ball joint is pushed by one of the elastic members toward the second connecting position, and the connecting member is swingable relative to the assembling member; wherein the working elastic abutting member is elastically engaged within the second recessed portion and the working member is nonswingable relative to the connecting member when the working ball joint is in the first working position; when the working ball joint is moved toward the second working position, the working elastic abutting member is disengaged from the second recessed portion, the working ball joint is pushed by one of the elastic members toward the second working position, and the working member is swingable relative to the connecting member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
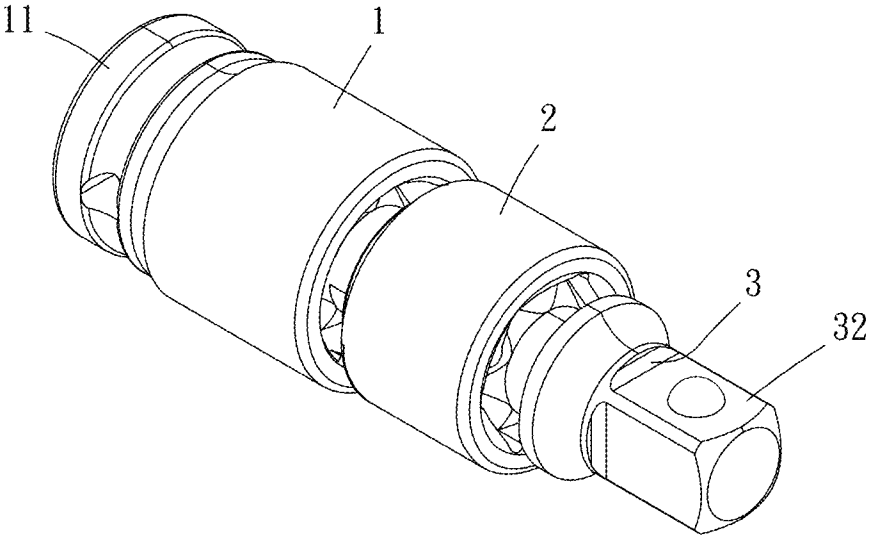
FIG. 1 is a stereogram of a preferable embodiment of the present invention.

Please refer to FIGS. 1 to 4 for a preferable embodiment of the present invention. A multi-section universal tool of the present invention includes an assembling member 1, a connecting member 2, a working member 3 and two elastic members 41.

The assembling member 1 has an assembling portion 11 and a first receiving room 12 which has a polygonal cross section, and an inner wall of the first receiving room 12 has a first recessed portion 13.

The connecting member 2 includes a connecting ball joint 21 which is polygonal and a second receiving room 22. The connecting ball joint 21 includes a connecting elastic abutting member 23 which has a tendency to move radially outward, and an inner wall of the second receiving room 22 has a second recessed portion 24. The connecting ball joint 21 is inserted into the first receiving room 12 and movable relative to the first receiving room 12 to be in a first connecting position and a second connecting position farther than the first connecting position from the assembling portion 11.

The working member 3 includes a working ball joint 31 which is polygonal and a working portion 32. The working ball joint 31 includes a working elastic abutting member 33 which has a tendency to radially move outwardly, and the working ball joint 31 is inserted into the second receiving room 22 and movable relative to the second receiving room 22 to be in a first working position and a second working position. In this embodiment, the working portion 32 is configured to be assembled with a screwing member or a socket, and the assembling portion 11 is configured to be assembled with a driving tool. The first receiving room 12 and the second receiving room 22 each have a hexagonal cross section, and the connecting ball joint 21 and the working ball joint 31 are hexagonal ball-joints. The working portion 32 is a square head, and the assembling portion 11 is a polygonal hole corresponding to an assembling end of the driving tool. The structures described above may be other polygonal structures.

One of the two elastic members 41 is disposed between the first receiving room 12 and the connecting ball joint 21 so that the connecting ball joint 21 has a tendency to move normally toward the second connecting position, and the other of the two elastic members 41 is disposed between the second receiving room 22 and the working ball joint 31 so that the working ball joint 31 has a tendency to move normally toward the second working position. In this embodiment, the two elastic members 41 are respectively tapered in a direction from the assembling member 1 toward the working member 3 and respectively abutted against respective end surfaces of the connecting ball joint 21 and the working ball joint 31 which face toward the assembling member 1.

The connecting elastic abutting member 23 is elastically engaged within the first recessed portion 13 and the connecting member 2 is nonswingable relative to the assembling member 1 when the connecting ball joint 21 is in the first connecting position. When the connecting ball joint 21 is moved toward the second connecting position, the connecting elastic abutting member 23 is disengaged from the first recessed portion 13, and the connecting ball joint 21 is pushed by one of the elastic members 41 toward the second connecting position and the connecting member 2 is swingable relative to the assembling member 1. The working elastic abutting member 33 is elastically engaged within the second recessed portion 24 and the working member 3 is nonswingable relative to the connecting member 2 when the working ball joint 31 is in the first working position. When the working ball joint 31 is moved toward the second working position, the working elastic abutting member 33 is disengaged from the second recessed portion 24, and the working ball joint 31 is pushed by one of the elastic members 41 toward the second working position and the working member 3 is swingable relative to the connecting member 2. The two elastic members 41 can respectively prevent respective free movement of the connecting ball joint 21 and the working ball joint 31 toward the first connecting position and the first working position. The connecting ball joint 21 and the working ball joint 31 may be moved to the second connecting position and the second working position respectively so that the multi-section universal tool is stretchable and bendable to various angles so as to be operated at a narrow and long space. In other embodiments, the multi-section universal tool may include more than two connecting members assembled to one another so as to elongate the multi-section universal tool.

Specifically, the first recessed portion 13 is a first annular groove 131 which is disposed on the inner wall of the first receiving room 12, and the second recessed portion 24 is a second annular groove 241 which is disposed on the inner wall of the second receiving room 22. In other embodiments, the first recessed portion and the second recessed portion may be through holes which can receive the connecting elastic abutting member and the working elastic abutting member therewithin.

The inner walls of the first receiving room 12 and the second receiving room 22 respectively have a plurality of projections 51 extending axially, and the connecting ball joint 21 and the working ball joint 31 respectively have a plurality of arcuate faces 52. Each of the plurality of arcuate faces 52 of the connecting ball joint 21 is abutted against one of the projections 51 of the first receiving room 12, and each of the plurality of arcuate faces 52 of the working ball joint 31 is abutted against one of the projections 51 of the second receiving room 22. In this embodiment, the first receiving room 12 and the second receiving room 22 respectively have a plurality of concaves 53 extending axially, and the plurality of projections 51 and the plurality of concaves 53 of respective one of the inner walls of the first receiving room 12 and the second receiving room 22 are circumferentially disposed alternatively. The first annular groove 131 and the second annular groove 241 respectively extend across the plurality of projections 51 and the plurality of concaves 53 of respective one of the inner walls of the first receiving room 12 and the second receiving room 22. Between every adjacent two of the plurality of arcuate faces 52 of respective one of the connecting ball joint 21 and the working ball joint 31 is a corner portion 54 which is abutted against one of the plurality of concaves 53 so as to prevent respective free swing of the connecting ball joint 21 and the working ball joint 31 relative to the first receiving room 12 and the second receiving room 22.

Figure 2:
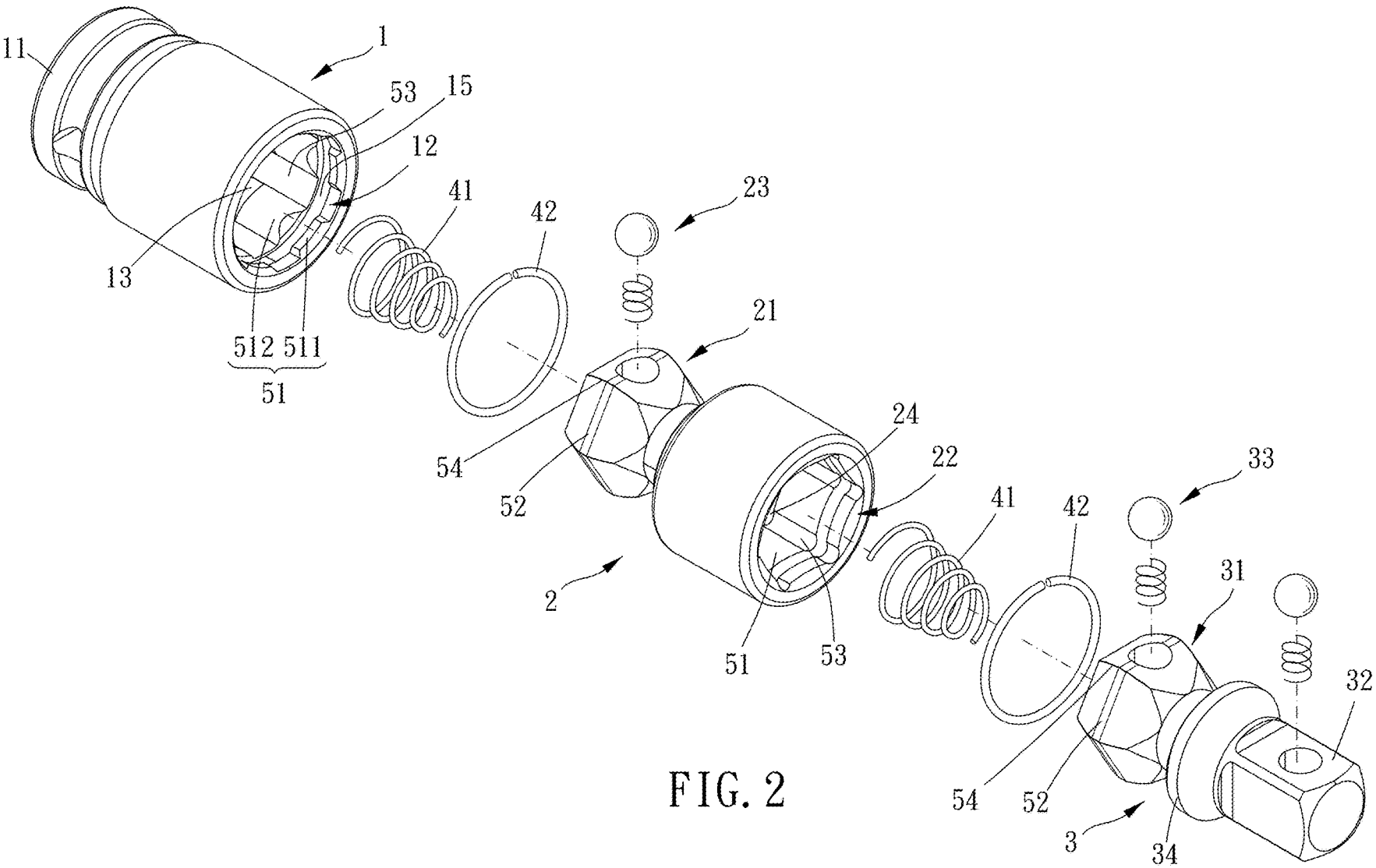
FIG. 2 is a breakdown drawing of a preferable embodiment of the present invention.
Figure 2A:
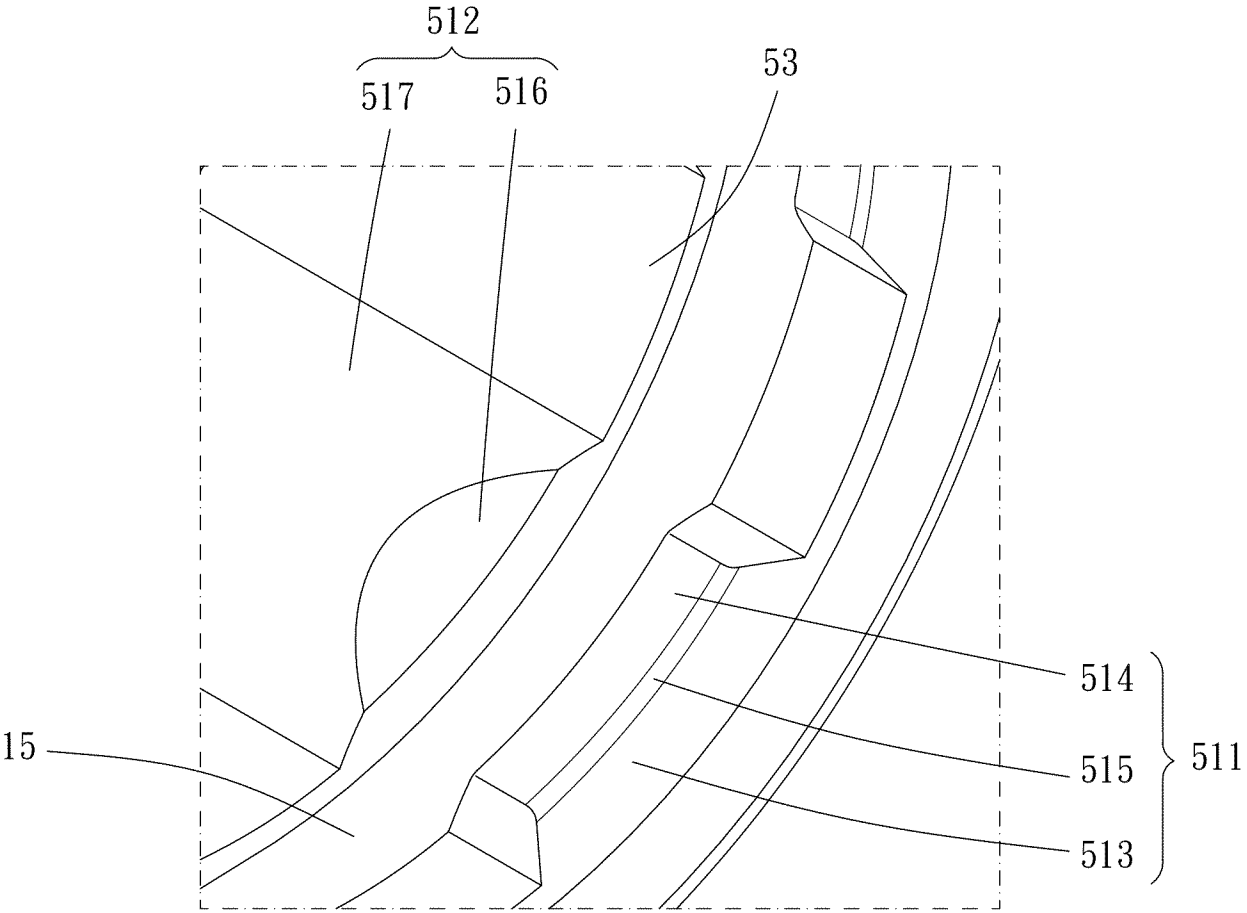
FIG. 2A is a partial enlargement of an assembling member according to a preferable embodiment of the present invention.
Figure 2B:
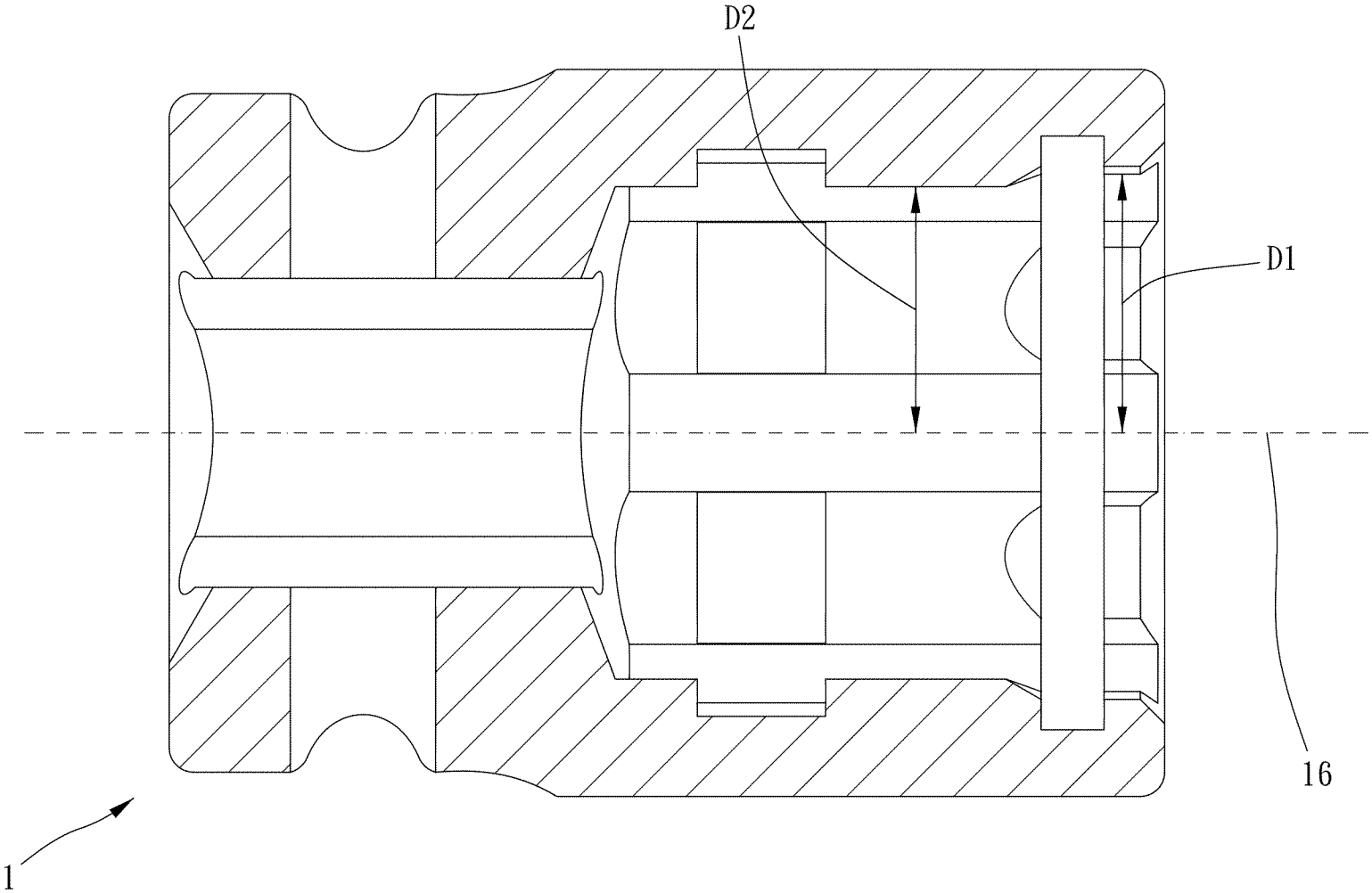
FIG. 2B is a cross-sectional view of the assembling member according to a preferable embodiment of the present invention.
Figure 3:
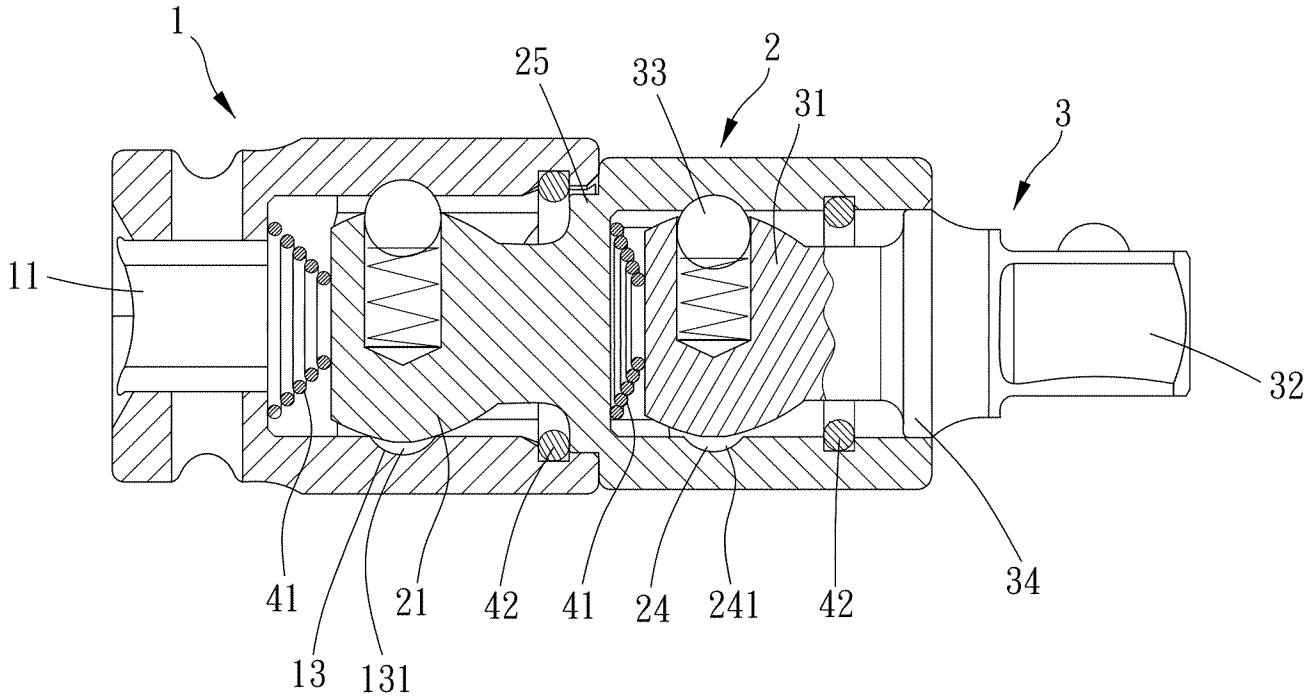
FIG. 3 is a cross-sectional view of a preferable embodiment of the present invention.
Figure 4:
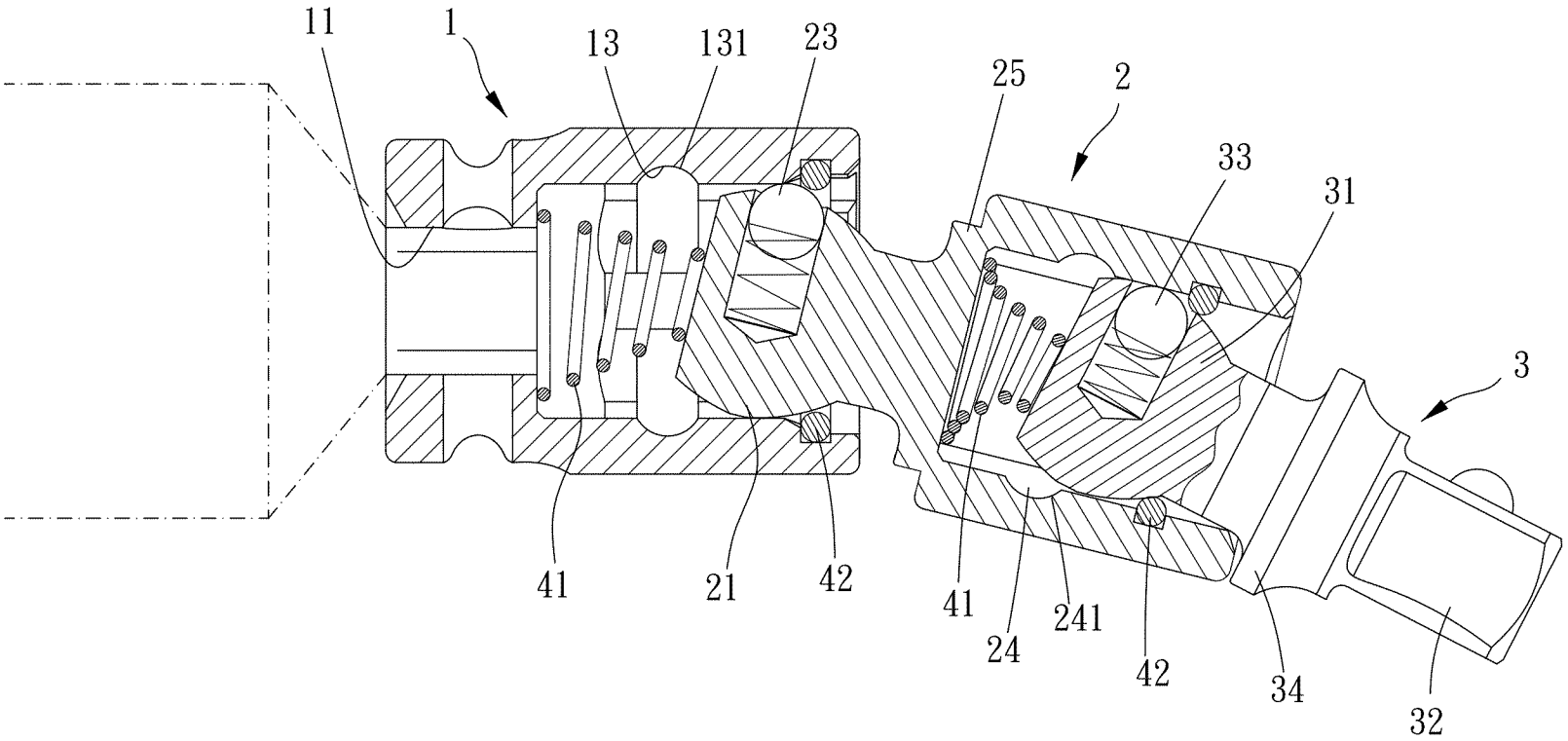
FIG. 4 is a cross-sectional view of a preferable embodiment of the present invention in use.

Please further refer to FIGS. 2A and 2B, specifically, the plurality of projections of the inner wall of the first receiving room 12 includes a plurality of first blocking projections 511 and a plurality of second blocking projections 512 extending axially, the plurality of first blocking projections 511 are disposed at an end of the assembling member 1 away from the assembling portion 11 and circumferentially arranged separately, the plurality of second blocking projections 512 are circumferentially arranged separately, the assembling member 1 further includes an annular recess 15 between the plurality of first blocking projections 511 and the plurality of second blocking projections 512, each of the plurality of second blocking projections 512 corresponds axially to and separate from one of the plurality of first blocking projections 511, each of the plurality of first blocking projections 511 includes a first inclined surface 513 which is located at an end of one said first blocking projection 511 away from the second blocking projection 512 and a first abutting surface 514 which faces radially inward, each of the plurality of first blocking projections 511 further includes an arcuate chamfer 515 connected between the first inclined surface 513 and the first abutting surface 514, each of the plurality of second blocking projections 512 includes a second inclined surface 516 which is located at an end of one said second blocking projection 512 near the first blocking projection 511 and a second abutting surface 517 which faces radially inward, and a distance D1 from each said first abutting surface 514 to a central axis 16 of the assembling member 1 is greater than a distance D2 from each said second abutting surface 517 to the central axis 16 of the assembling member 1.

An end outside surface of the connecting member 2 is abutted axially against an end surface of the assembling member 1 when the connecting member 2 is in the first connecting position, and the end outside surface of the connecting member 2 is distanced from the end surface of the assembling member 1 when the connecting member 2 is in the second connecting position so as to prevent free swing of the connecting member 2 relative to the assembling member 1.

The working member 3 further has a radial flange 34 which is integrally formed therewith. The radial flange 34 is disposed between the working portion 32 and the working ball joint 31. The radial flange 34 is abutted against the inner wall of the second receiving room 22 when the working member 3 is in the first working position so as to prevent free swing of the working member 3 relative to the connecting member 2, and the radial flange 34 is unabutted against the inner wall of the second receiving room 22 when the working member 3 is in the second working position. Preferably, the connecting member 2 further includes a stepped portion 25, and the stepped portion 25 is abuttable against the inner wall of the first receiving room 12 so as to prevent free swing of the connecting member 2 relative to the assembling member 1 when the connecting member 2 is in the first connecting position.

Preferably, each of the inner walls of the first receiving room 12 and the second receiving room 22 further has a restricting member 42 detachably disposed thereon. The restricting member 42 of the first receiving room 12 blocks the connecting ball joint 21 from detaching from the first receiving room 12 when the connecting ball joint 21 is moved to the second connecting position, and the restricting member 42 of the second receiving room 22 blocks the working ball joint 31 detaching from the second receiving room 22 when the working ball joint 31 is moved to the second working position.

Figure 5:
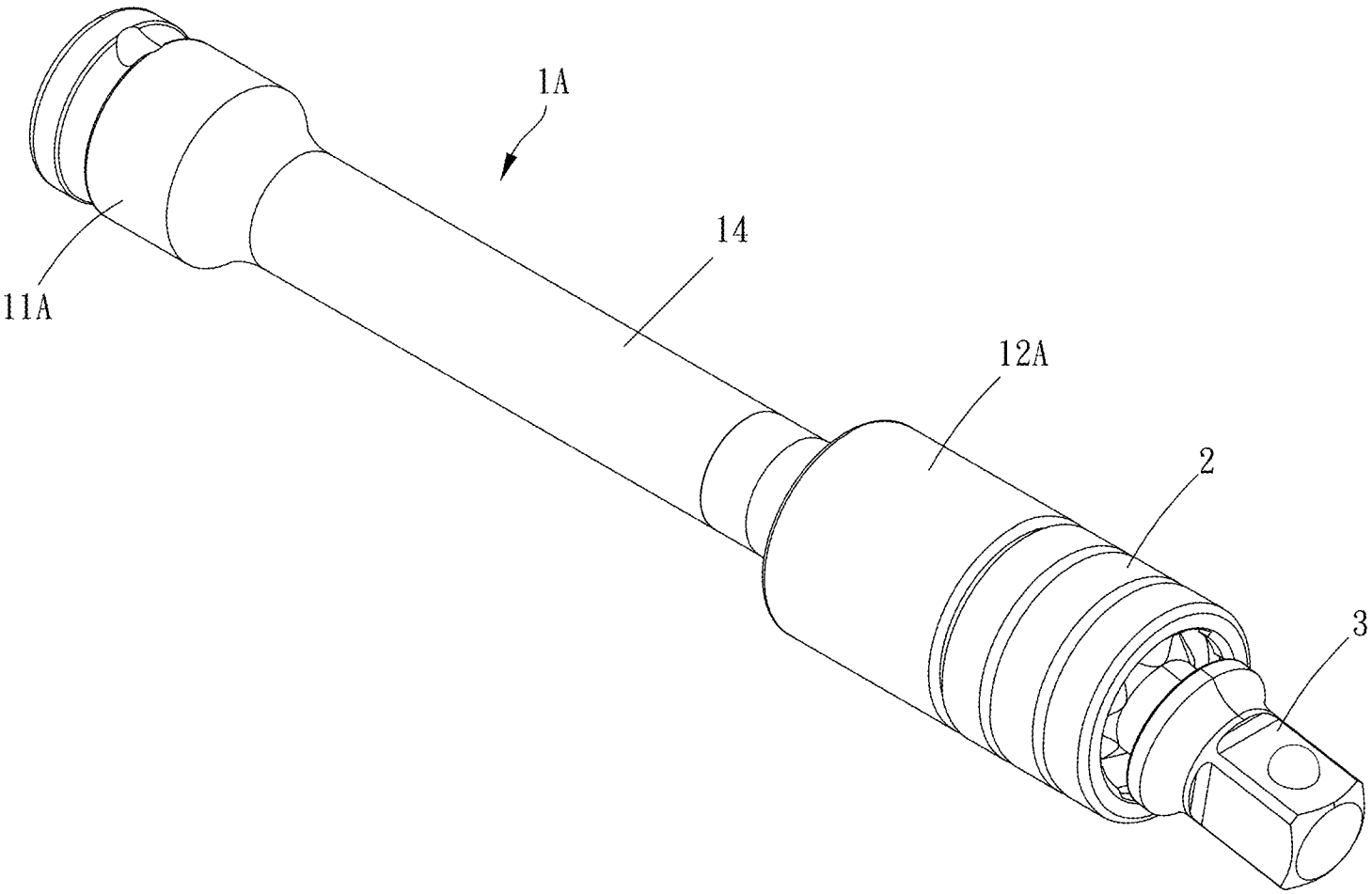
FIG. 5 is a stereogram of another preferable embodiment of the present invention.
Figure 6:
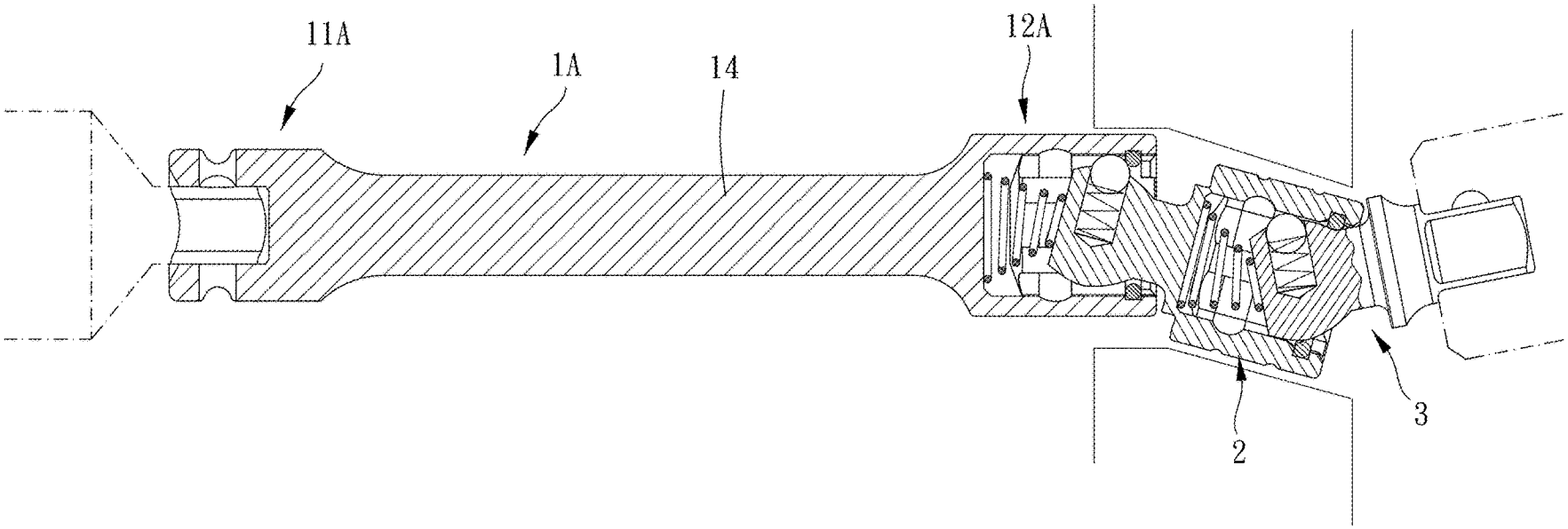
FIG. 6 is a cross-sectional view of another preferable embodiment of the present invention in use.

Referring to FIGS. 5 and 6, the assembling member 1A further includes an extending rod 14, and two ends of the extending rod 14 are connected to the assembling portion 11A and the first receiving room 12A respectively so as to increase a length of the multi-section universal tool.

In summary, the multi-section universal tool of the present invention can be used in a long and narrow space. The connecting ball joint and the working ball joint are rapidly positionable without free movement by utilizing cooperation of the first recessed portion, the second recessed portion and the two elastic members.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multi-section universal tool, including: an assembling member, having an assembling portion and a first receiving room which has a polygonal cross section, an inner wall of the first receiving room has a first recessed portion;

a connecting member, including a connecting ball-joint which is polygonal and a second receiving room, the connecting ball-joint including a connecting elastic abutting member which has a tendency to move radially outward, an inner wall of the second receiving room having a second recessed portion, the connecting ball-joint being inserted into the first receiving room and movable relative to the first receiving room to be in a first connecting position or a second connecting position farther than the first connecting position from the assembling portion;

a working member, including a working ball-joint which is polygonal and a working portion, the working ball-joint including a working elastic abutting member which has a tendency to radially move outwardly, the working ball-joint being inserted into the second receiving room and movable relative to the second receiving room to be in a first working position or a second working position farther than the first working position from the connecting ball-joint;

two elastic members, one of the two elastic members being disposed between the first receiving room and the connecting ball-joint so that the connecting ball-joint has a tendency to move normally toward the second connecting position, and the other of the two elastic members being disposed between the second receiving room and the working ball-joint so that the working ball-joint has a tendency to move normally toward the second working position;

wherein the connecting elastic abutting member is elastically engaged within the first recessed portion and the connecting member is nonswingable relative to the assembling member when the connecting ball-joint is in the first connecting position; when the connecting ball-joint is moved toward the second connecting position, the connecting elastic abutting member is disengaged from the first recessed portion, the connecting ball-joint is pushed by one of the elastic members toward the second connecting position, and the connecting member is swingable relative to the assembling member;

wherein the working elastic abutting member is elastically engaged within the second recessed portion and the working member is nonswingable relative to the connecting member when the working ball-joint is in the first working position; when the working ball-joint is moved toward the second working position, the working elastic abutting member is disengaged from the second recessed portion, the working ball-joint is pushed by one of the elastic members toward the second working position, and the working member is swingable relative to the connecting member;

wherein the inner wall of the first receiving room includes a plurality of projections extending axially, the plurality of projections includes a plurality of first blocking projections and a plurality of second blocking projections extending axially, the plurality of first blocking projections are disposed at an end of the assembling member away from the assembling portion and circumferentially arranged separately, the plurality of second blocking projections are circumferentially arranged separately, the assembling member further includes an annular recess between the plurality of first blocking projections and the plurality of second blocking projections, each of the plurality of second blocking projections corresponds axially to and separate from one of the plurality of first blocking projections, each of the plurality of first blocking projections includes a first inclined surface which is located at an end of one said first blocking projection away from the second blocking projection and a first abutting surface which faces radially inward, each of the plurality of first blocking projections further includes an arcuate chamfer connected between the first inclined surface and the first abutting surface, each of the plurality of second blocking projections includes a second inclined surface which is located at an end of one said second blocking projection near the first blocking projection and a second abutting surface which faces radially inward, and a distance from each said first abutting surface to a central axis of the assembling member is greater than a distance from each said second abutting surface to the central axis of the assembling member.

2. The multi-section universal tool of claim 1, wherein the first recessed portion is a first annular groove which is disposed on the inner wall of the first receiving room, and the second recessed portion is a second annular groove which is disposed on the inner wall of the second receiving room.

3. The multi-section universal tool of claim 2, wherein the inner wall of the second receiving room includes a plurality of projections extending axially, the connecting ball-joint and the working ball-joint respectively have a plurality of arcuate faces, each of the plurality of arcuate faces of the connecting ball-joint is abutted against one of the projections of the first receiving room, and each of the plurality of arcuate faces of the working ball-joint is abutted against one of the projections of the second receiving room.

4. The multi-section universal tool of claim 3, wherein the inner walls of the first receiving room and the second receiving room respectively have a plurality of concaves extending axially, the plurality of projections and the plurality of concaves of respective one of the inner walls of the first receiving room and the second receiving room are circumferentially disposed alternatively, the first annular groove and the second annular groove respectively extend across the plurality of projections and the plurality of concaves of respective one of the inner walls of the first receiving room and the second receiving room, between every adjacent two of the plurality of arcuate faces of respective one of the connecting ball-joint and the working ball-joint is a corner portion which is abutted against one of the plurality of concaves.

5. The multi-section universal tool of claim 1, wherein the assembling member further includes an extending rod, and two ends of the extending rod are connected to the assembling portion and the first receiving room respectively.

6. The multi-section universal tool of claim 1, wherein an end outside surface of the connecting member is abutted axially against an end surface of the assembling member when the connecting member is in the first connecting position, and the end outside surface of the connecting member is distanced from the end surface of the assembling member when the connecting member is in the second connecting position.

7. The multi-section universal tool of claim 1, wherein the working member further has a radial flange which is integrally formed therewith, the radial flange is disposed between the working portion and the working ball-joint, the radial flange is abutted against the inner wall of the second receiving room when the working member is in the first working position, and the radial flange is unabutted against the inner wall of the second receiving room when the working member is in the second working position.

8. The multi-section universal tool of claim 1, wherein each of the inner walls of the first receiving room and the second receiving room further includes a restricting member detachably disposed thereon, the restricting member of the first receiving room blocks the connecting ball-joint from detaching from the first receiving room when the connecting ball-joint is moved to the second connecting position, and the restricting member of the second receiving room blocks the working ball-joint from detaching from the second receiving room when the working ball-joint is moved to the second working position.

9. The multi-section universal tool of claim 1, wherein the two elastic members are respectively tapered in a direction from the assembling member toward the working member and respectively abutted against respective end surfaces of the connecting ball-joint and the working ball-joint which face toward the assembling member.

10. The multi-section universal tool of claim 1, wherein the first receiving room and the second receiving room each have a hexagonal cross section, the connecting ball-joint and the working ball-joint are hexagonal ball-joints, the working portion is a square head, and the assembling portion is a polygonal hole.

* * * * *